United States Patent [19]

Roberts et al.

[11] Patent Number: 4,864,713

[45] Date of Patent: Sep. 12, 1989

[54] METHOD AND APPARATUS FOR POSITIONING TOOLING AND RIVETING

[75] Inventors: Bradley M. Roberts, Williamsville; Robert J. Kellner, Orchard Park, both of N.Y.

[73] Assignee: Gemcor Engineering Corp., Buffalo, N.Y.

[21] Appl. No.: 203,683

[22] Filed: Jun. 7, 1988

[51] Int. Cl.[4] ..... B21D 39/00; B23P 11/02; B23P 21/00; B23B 11/00

[52] U.S. Cl. ..... 29/524.1; 29/559; 29/33 K; 29/34 B; 29/715; 29/243.54; 29/525.2

[58] Field of Search ..... 29/525.2, 509, 715, 29/524.1, 243.53, 243.54, 33 K, 564.1, 559, 564.2

[56] References Cited

U.S. PATENT DOCUMENTS

| | | | |
|---|---|---|---|
| 2,328,821 | 9/1943 | Lyon | 29/526.2 X |
| 2,957,237 | 10/1960 | Regle et al. | 29/526 X |
| 3,030,695 | 4/1962 | White et al. | 29/34 B X |
| 3,292,413 | 12/1966 | Falcioni | 29/526.2 X |
| 3,557,442 | 1/1971 | Speller | 29/509 X |
| 3,874,070 | 4/1975 | Falcioni | 29/526.2 |
| 4,192,058 | 3/1980 | Falcioni | 29/509 X |
| 4,493,141 | 1/1985 | Krezak | 29/509 |
| 4,515,302 | 5/1985 | Davern | 29/243.54 X |

FOREIGN PATENT DOCUMENTS

| | | | |
|---|---|---|---|
| 1103930 | 7/1984 | U.S.S.R. | 29/34 B |

*Primary Examiner*—Charlie T. Moon

*Attorney, Agent, or Firm*—Christel, Bean & Linihan

[57] ABSTRACT

A method and apparatus for positioning tooling and riveting the apparatus including a frame provided with opposed riveting rams (96, 86) and clamps (34, 36). The first clamp (34) is extended above the work plane established by the outer surface of one workpiece (10) with the lower ram retracted. Next, the frame (26) is moved downwardly until the first clamp touches the workpiece. An encoder (140) measured the amount of first clamp collapse during overtravel of the frame after the first touch is sensed. The frame is now backed off this distance to establish a work line coextensive with the work plane. The lower clamp (36) is then raised to clamp the workpieces (10, 12) and drill carried by a sub-frame (66) will now drill aligned apertures through the workpieces. The subframe is indexed to another position to place rams (96, 86) is alignment with the apertures. The upper riveting ram (96) is then advanced to its full down position to set an upper cavity and is locked under high pressure. The lower ram (86) then rises under low pressure to a snug up position. Squeeze forming is now accomplished by simultaneously controlled motion of the frame down and the lower ram up until an upset complete signal is received. During this operation the upper clamp (34) is in a resilient condition. When the rivet is completely upset pressure is dumped from the upper clamp and simultaneously the frame is driven to its start position and the lower ram is retracted. As soon as the lower ram reaches its back away position the upper riveting ram is fully retracted.

28 Claims, 4 Drawing Sheets

| | 114 | 118 | 112 | 102 | 104 | 110 | 108 |
|---|---|---|---|---|---|---|---|
| INITIAL POSITION | B | U | U | U | B | B | C |
| 1 | B | U | U | D | B | B | C |
| 2 | B | U | U | D | B | B | C |
| 3 | B | U | U | D | B | B | C |
| 4 | B | U | U | D | B | B | C |
| 5 | B | U | U | D | O | B | C |
| 6 | B | U | U | D | O | U | U |
| 7 | B | U | U | D | O | U | B |
| 8 | B | DU | U | D | O | U | B |
| 9 | B | U | U | D | O | U | B |
| 10 | B | U | D | D | O | U | B |
| 11 | O | U | D | D | O | U | B |
| 12 | O | U | D | D | O | U | U |
| 13 | O | U | D | D | B | U | B |
| 14 | O | U | D | D | B | U | U |
| 15 | O | U | D | D | B | B | SU |
| 16 | O | U | D | D | B | B | SU |
| 17 | O | U | D | D | B | SD | SU |
| 18 | B | U | D | D | B | B | C |
| 19 | B | U | D | D | B | U | SD |
| 20 | B | U | D | D | B | U | SD |
| 21 | B | U | D | D | B | B | C |
| 22 | B | U | U | D | B | B | C |
| 23 | B | U | U | D | B | B | C |
| 24 | B | U | U | D | B | B | C |
| 25 | B | U | U | U | B | B | C |

Fig. 12.

METHOD AND APPARATUS FOR POSITIONING TOOLING AND RIVETING

TECHNICAL FIELD

The present invention relates generally to a method and apparatus for positioning tooling and riveting, and more particularly to a method and apparatus of positioning tooling and clamping two or more side by side free standing workpieces in such a manner that the outer surface of one of the workpieces is not deflected, and of subsequently riveting together the workpieces wherein both ends of a slug rivet are simultaneously upset during riveting without the outer surface of the one workpiece being deflected.

BACKGROUND OF THE INVENTION

In the aircraft industry a large number of rivets are utilized when fabricating a single aircraft. Because of the large number of rivets which are used, and also because of the requirements for virtually indefinite life of the rivets, much attention has been given in the industry to various methods and apparatus for riveting. One riveting method and apparatus which has been utilized by the industry for a number of years is shown in U.S. Pat. No. 3,557,442. This patent discloses the utilization of slug rivets to secure two workpieces together, the workpieces initially being clamped together. This patent teaches that the upper rivet forming anvil is initially extended to a full down locked position, with all of the rivet upsetting force then being applied by the upward movement of the lower rivet forming anvil, the ends of the rivet being simultaneously formed. During the riveting process the surface of the workpieces will move relative to a fixed work plane. This is referred to in the industry as a "wink".

The process of the foregoing patent requires that the workpieces be initially stacked together, held in a fixture, and then subsequently clamped together prior to riveting. When the workpieces are rigidly held externally relative to the apparatus, such as in a rigid fixture, and the clamps are brought to the opposite sides of the workpieces it is desirable that the clamps not apply any bias force so as to avoid any deformation of the workpieces. Related to the requirement of avoiding any deformation of the workpieces is the need to establish a work line reference for the automatic fastening machine. In particular, there is need to coordinate operation of the fastening machine with variations in the work line. This is essential in spar work where there may be no common work plane. In other structures, such as a rigidly held wing panel, it is also needed due to random variations which the machine needs to accommodate.

In situations where the workpieces are not rigidly held, and are therefore allowed some degree of movement when clamped, prior art clamps can apply a bias force to the workpiece and thus wink or move the workpieces during clamping.

As the workpieces are winked or moved during the clamping or during the squeeze cycle they will have a tendency to oscillate before returning to their original position. This oscillation could delay the next operation. Additionally, if a slug rivet can be formed without winking better control of the position of the slug can be achieved. As there would be no movement of the workpiece even greater uniformity of the bulging of the rivet may be achieved which is desirable for rivet fatigue life cycles. In addition, by not moving the workpiece during riveting there is a potential for even faster rate times.

It would, therefore, be desirable to provide a new and improved apparatus for clamping and fastening workpieces which sense contact with the workpiece surface to establish a reference work plane and which applies no bias force to the workpieces so as to avoid deformation thereof.

OBJECTS AND SUMMARY OF THE INVENTION

It is a principle object of the present invention to provide an improved method and apparatus for positioning tooling and clamping two or more side by side workpieces which are to be assembled together in such a manner that the outer surface of one of the workpieces is not deflected when clamped, the outer surface establishing a reference work plane, and of subsequently riveting together the workpieces wherein both ends of a slug rivet are simultaneously upset during riveting without the outer surface of one of the workpieces being deflected.

More particularly, it is an object of the present invention to provide a method and apparatus for moving tooling into position adjacent workpieces which are not supported by the frame which supports the tooling, and to clamp the workpieces relative to the frame without movement of the workpieces, the outer surface of one of the workpieces establishing a reference work plane.

It is a further object of the present invention to provide a method and apparatus for upsetting a slug rivet which has been positioned within aligned apertures in two or more side by side workpieces without movement of the workpieces during upsetting.

The foregoing objects and other objects of the invention are accomplished by providing an apparatus having opposed clamps supported by a frame, which clamps will clamp together two or more workpieces prior to riveting, the outer surface of one of the workpieces establishing a reference work plane. The first clamp is initially extended and disposed above the work plane with the lower ram retracted. Next, the frame is moved downwardly until the first clamp touches the workpiece which touch is sensed. An encoder extending between the extended first clamp and its supporting structure measures the amount of first clamp collapse during the overtravel of the frame after the first touch is sensed. The frame is now backed off this distance thereby establishing a work line which is coextensive with the work plane. The lower clamp is then raised to clamp the workpieces, and aligned apertures are then drilled through the workpieces by a drill carried by a sub-frame shiftably carried by the frame. After drilling the sub-frame is moved to a second position to place concentric riveting rams in alignment with the apertures. The upper riveting ram is then advanced to its full down position to set an upper cavity and is locked under high pressure. The lower ram then rises under low pressure to a snug up position where the upper and lower riveting rams are just in contact with a slug rivet. Squeeze forming is accomplished by simultaneously controlled motion of the frame down and the lower ram up until an upset complete signal is received. During this operation the upper clmap is in a resilient condition. When the rivet is completely upset, pressure is dumped from the upper clamp and simultaneously the frame is driven to its start position and the lower ram is retracted. As soon as the lower ram reaches its back away position the upper riveting ram is fully retracted. An apparatus has been developed for carrying out the process described above and it has been found in test work that movement of the surface which lies in the substantially fixed work plane can be held to less than 5 thousandths of one inch.

The foregoing will be more fully understood after a consideration of the following detailed description taken in conjunction with the accompanying drawings.

BRIEF DESCRIPTION OF THE DRAWINGS

FIG. 12 is a table illustrating the position of the various valves shown in FIG. 2 at the completion of each of the operational steps of this invention.

DETAILED DESCRIPTION

Figure 1:
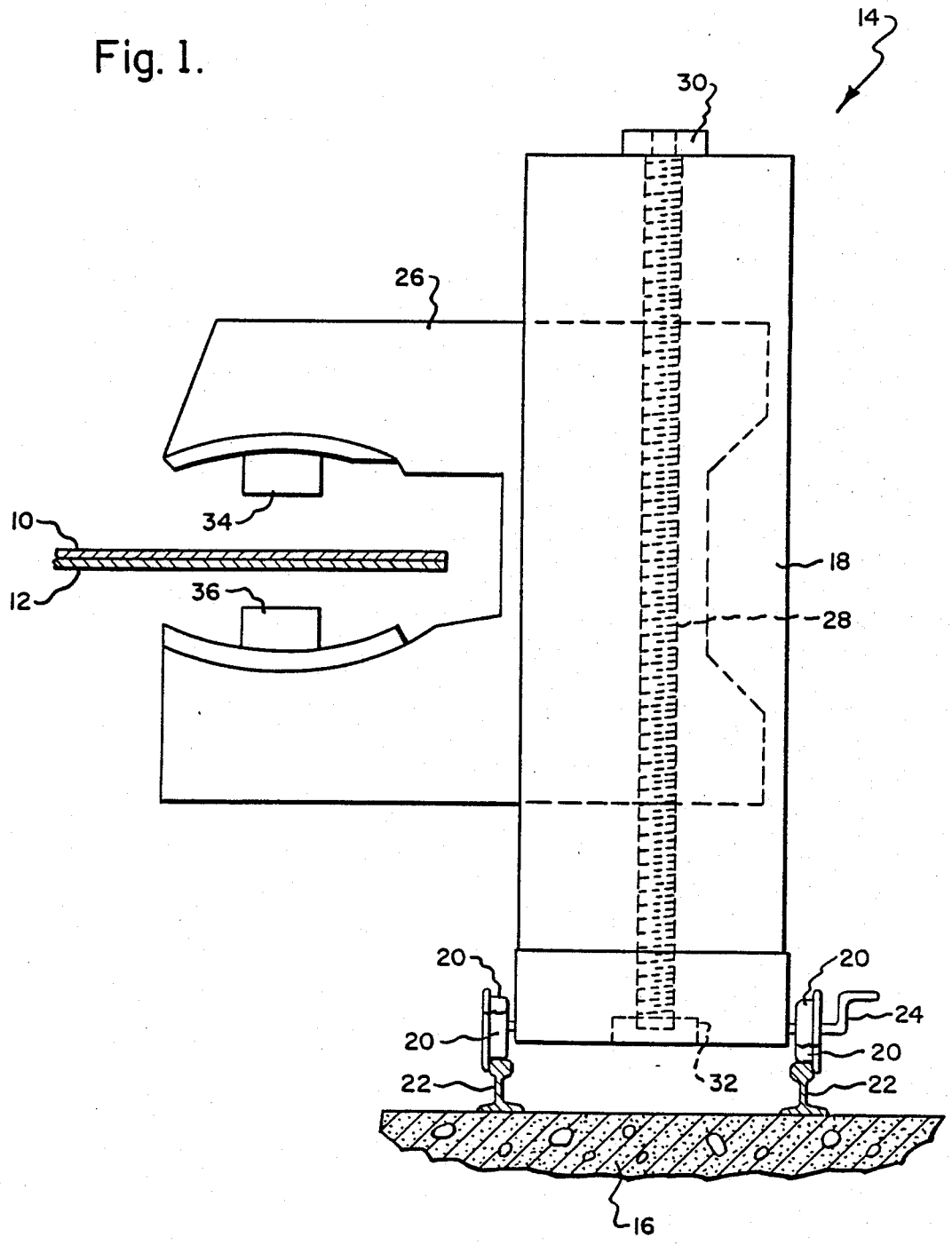
FIG. 1 is a side elevational somewhat schematic illustration of the apparatus in which the principles of the present invention have been incorporated.
Figure 2:
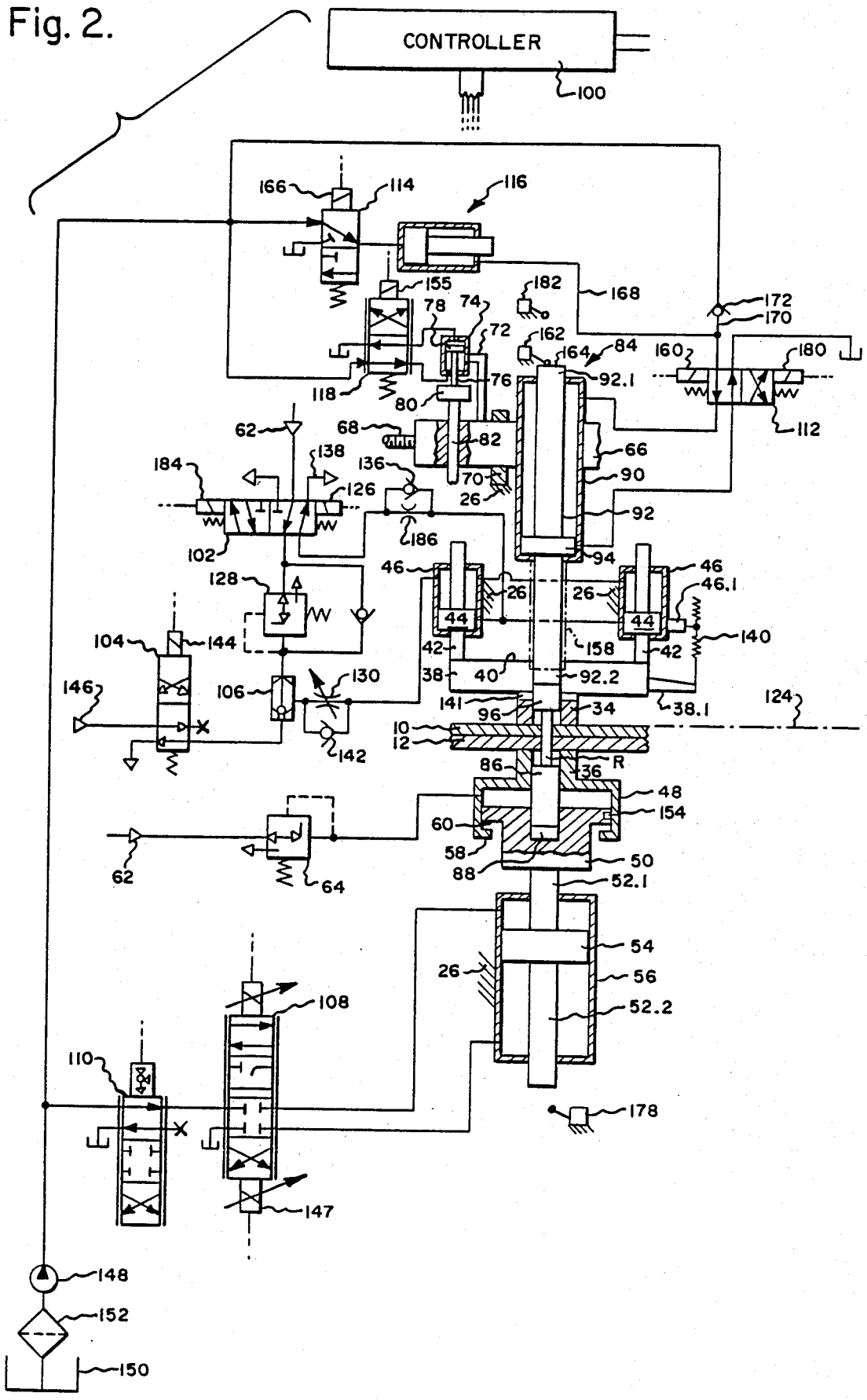
FIG. 2 is a schematic illustration of a portion of the apparatus of this invention showing tooling and clamps carried by the frame and various control devices, the parts being shown in that position which they would occupy after the completion of step 13 below.

Reference will be made initially to FIGS. 1 and 2 in which the apparatus of this invention is illustrated. Two workpieces which are to be joined together are indicated at 10 and 12, respectively. While only two workpieces are illustrated in the figures, it should be appreciated that more than two workpieces could be joined together by the riveting apparatus of this invention, which riveting apparatus is indicated generally at 14 in FIG. 1. Because of the size of the workpieces, which may be a complete wing assembly for a commercial jet aircraft the workpieces 10 and 12 will be held stationary with respect to the floor or base 16 upon which the apparatus rests and the apparatus 14 will be moved with respect to the workpieces as a number of separate slug rivets R will be utilized to hold the workpieces together. The apparatus includes a main structure 18 which is provided at its lower end with rail wheels 20 which rest upon rails 22 secured to the base or floor 16. The structure may be moved upon the rails in any conventional manner and thus, for purposes of illustration, means in the form of a crank 24 is shown for moving the apparatus relative to the workpieces 10 and 12.

Mounted upon the main structure 18 is a frame 26, which frame may be moved relative to the structure 18. Thus, the frame as shown in FIG. 1 may be moved up and down relative to the structure 18, as well as to the right or left and in other manners which are not material to the present invention. However, as shown in FIG. 1, the frame 26, which supports various of the components shown in FIG. 2, is mounted for vertical shifting movement along an axis defined by a screw 28. This screw is interconnected with the frame 26 so that there is substantially no backlash. The screw may be rotated by a servo motor 30 which, for purposes of illustration, is shown at the upper end of the main structure 18, the lower end of the screw 28 being shown journalled within a thrust bearing 32. Suitable guides (not shown) are provided to insure that the frame 26 will move vertically within the main structure 18.

Carried by the frame 26 are first and second clamps 34, 36, respectively. As can best be seen in FIG. 2, the first clamp or upper pressure foot bushing 34 is interconnected with an upper pressure foot plate 38. The upper surface 40 of the upper pressure foot bushing plate 38 is in turn connected to the lower end of piston rods 42, the upper end of which rods are in turn secured to pistons 44 disposed within pressure foot air cylinders 46. While only two air cylinder assemblies are shown in FIG. 2, in practice four may be used. The air cylinders 46 are in turn rigidly connected to the frame 26. By introducing air into the cylinders 46 in an appropriate manner the first clamp 34 can be moved relative to the frame 26 from a raised or retracted position (not shown) to a lowered or extended position shown in FIG. 2. The means for raising and lowering the first clamp 34 will be described below in connection with a description of the operation of this apparatus.

The second clamp 36, which is also referred to as the lower pressure foot bushing, is an integral part of a lower clamp cylinder 48 which is supported upon the second or lower clamp piston 50. The piston 50 is in turn secured to the upper portion 52.1 of a piston rod which carries between its upper portion and its lower portion 52.2 a piston 54 which is disposed within a lower ram cylinder 56, which cylinder is rigidly secured to the frame 26. When the piston 54 is in a lower position within the cylinder 56 air introduced into the lower clamp cylinder 48 above the piston 50 will cause the second clamp 36 to be shifted to an extended position where the flange 58 on the lower clamp cylinder 48 abuts against a stop surface 60 on the lower clamp piston 50. Thus low pressure air, indicated by arrow 62, is normally introduced into the lower clamp cylinder 48, the air passing through a lower ram clamp pressure regulator 64. The second clamp 36 will normally be fully extended by the air 62 when the piston 54 is in a lower position within cylinder 56, but will move to an intermediate position when the piston is raised, as shown in FIG. 2, the pressure being exerted by the second clamp being determined by the setting of the pressure regulator 64. The operation of the second clamp and its mounting structure will become more apparent after a consideration of the operation set forth below.

The frame 26 in addition to carrying cylinders 46 and 56 also carries a sub-frame 66, the sub-frame being movable between first and second positions, the sub-frame being shown in its second position in FIG. 2. The means for moving the sub-frame between its first and second positions may be a stepping motor (not shown) and threaded shaft, shown partially at 68, which stepping motor may be mounted on the frame 26. The sub-frame is supported in a slide bearing portion 70 of frame 26 for movement in a plane which is perpendicular to the axis of the bushings 34, 36. Mounted upon the sub-frame 66 is a bracket 72 which carries at its upper end a cylinder 74. A piston rod 76, the upper end of which is connected to a piston 78 within the cylinder 74 has its lower end connected to a drill motor 80. The drill motor 80 is slideable within guides (not shown) to keep the motor from rotating. An arbor 82 extends out of the drill motor and passes through an aperture in the sub-frame, the lower end of the arbor being provided with a chuck (not shown) to which a drill may be secured.

When the subframe 66 is in its first position the arbor 82 of the drill motor will be held in the position which is concentric with the center lines of the first and second clamp bushings 34, 36. When drilling the drill motor can be raised and lowered by introduction of hydraulic fluid into the cylinder 74, the drill motor being operated by any suitable manner, such as by electricity, or by fluid power. The operation of the drill assembly will become more apparent after a consideration of the following operation.

When the sub-frame is indexed to the second position, shown in FIG. 2, a first or upper riveting ram assembly, indicated generally at 84, will be placed in concentric alignment with the center line of bushings 34, 36 and with a second or lower riveting ram or anvil 86. The second or lower riveting ram is carried by the second or lower clamp piston 50, there being a load cell 88 disposed between the lower end of the lower riveting ram and the piston 50. The first or upper riveting ram assembly 84 includes a first ram cylinder 90 which is rigidly mounted on the sub-frame 66, a piston rod 92 extending through both ends of the first ram cylinder 90 and having a piston 94 disposed between its upper and lower ends 92.1 and 92.2, respectively. A first riveting ram or anvil 96 is mounted concentrically on the lower end 92.2 of the piston rod. While each of the first and second riveting rams or anvils 96, 86, respectively are shown as integral constructions in FIG. 2, they may in fact have die buttons 98 (FIG. 7) secured to their working ends, which die buttons may be suitably shimmed to properly position the working surfaces which are to contact the slug rivet R.

In addition to the various parts described so far, various fluid control devices are provided, the operation of which fluid control devices are controlled by a controller 100. The various valves include, in addition to the lower ram clamp pressure regulator valve 64, a valve 102 for moving the first clamp 34 between its retracted and extended positions, a two position valve 104 which, in conjunction with a shuttle valve 106, may be used to lock the first clamp in an extended position, a lower ram proportional valve 108 and a lower ram servo pressure control valve 110, which valves 108 and 110 are used for positioning the second clamp 36 and the second or lower riveting ram 86. Other valves include a first ram cylinder control valve or buck ram valve 112, an intensifier control valve 114 which controls the flow of hydraulic fluid to an intensifier assembly indicated generally at 116, and a two position four port valve 118 which is utilized to control the position of the drilling arbor 82. Additional controls, sensors, and other valves will be described below in connection with the operation of the apparatus shown in FIGS. 1 and 2.

OPERATION

Initially the machine 14 is properly positioned about the workpieces 10, 12 so that the upper clamp bushing 34 and the lower clamp bushing 36 are coaxially aligned with that position where a slug rivet R is to be inserted. When properly positioned both first and second clamps 34, 36 are spaced away from the workpieces 10, 12 and the lower surface 120 (FIG. 3) of the upper clamp 34 is parallel to the top surface 122 of the top workpiece 10, which top surface establishes a work plane 124 (FIG. 2). Initially, the upper clamp bushing or first clamp 34 is in its "raised" or retracted position and the piston 54 which is interconnected with the lower clamp bushing or second clamp 36 is in a lowered intermediate standby position. Initially valves 104, 110, and 114 are in their blocking positions, valves 102, 112 and 118 are in their "up" position and valve 108 is in its centered position.

The following sequence of steps now takes place during a normal tooling positioning, drilling and riveting sequence:

Step 1

Figures 3, 4, 5, 6, 7, 8, 9, 10, 11:
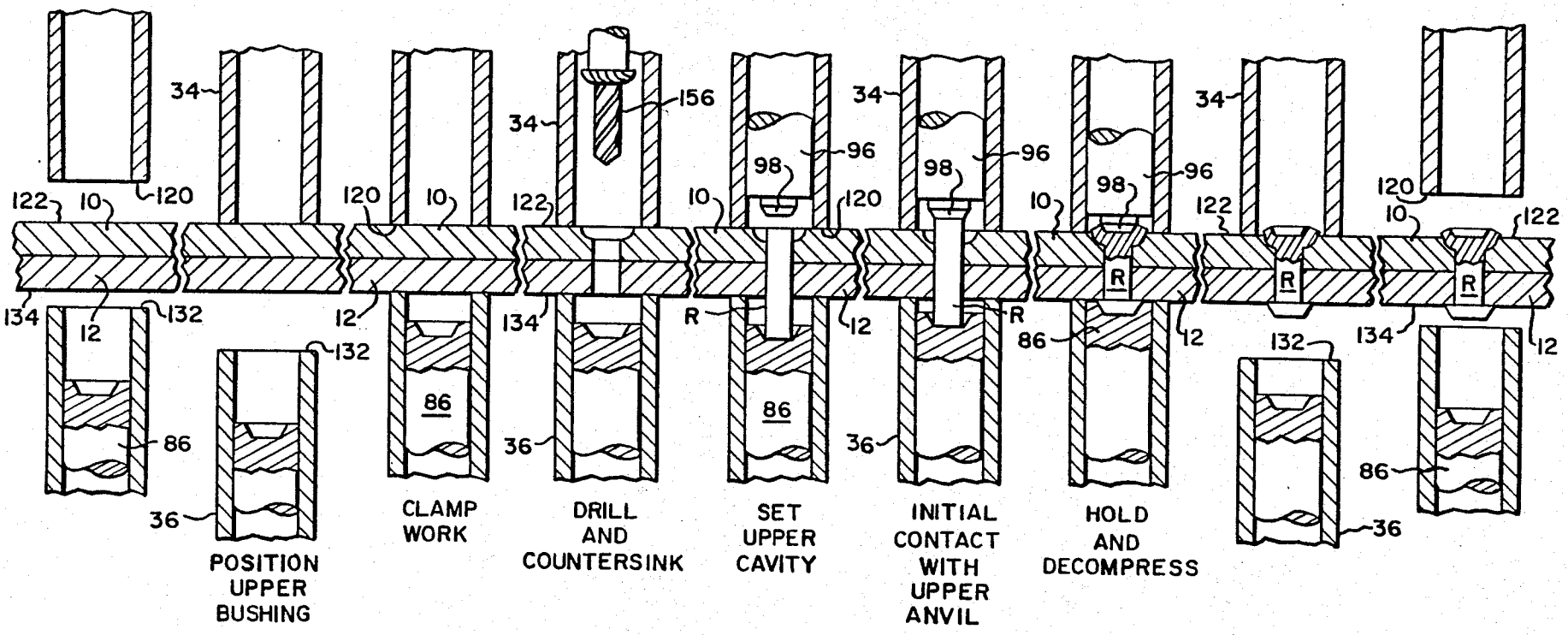
FIGS. 3 through 11 illustrate the sequence of operational steps utilized in the performance of the method of this invention.

Initially the controller will be caused to send a signal to the "down" solenoid 126 on the first clamp moving valve 102 (or upper pressure foot bushing valve) switching the valve to its "down" position. Low pressure air will now flow from a source of low pressure air, indicated by arrow 62 through the valve 102, through a pressure regulator valve 128, shuttle valve 106 and variable restrictor 130 to the upper end of air cylinders 46 thereby forcing pistons 44 downwardly until they bottom out within cylinders 46, the first clamp then being in its fully extended position. The completion of this step is shown in FIG. 3. As can be seen from this figure the lower surface 120 of the first clamp 34 and the upper surface 132 of the second clamp 36 will both be positioned away from the outer surfaces 122, 134 of workpieces 10 and 12, respectively. As the pistons 44 move downwardly within cylinders 46 air will be exhausted through check valve 136 to exhaust line 138.

Step 2

The controller 100 will now initiate the operation of servo motor 30 to cause the screw mechanism 28 to shift the frame 26 downwardly. The operation of motor 30 will continue until a sensing means indicates contact of the upper clamp bushing 34 with the top surface 122 of the top workpiece 10. The output of the sensing means is interconnected with the controller 100. The sensing means includes an encoder 140 and a proximity switch 141. The encoder is supported by a bracket 38.1 secured to the upper pressure foot bushing plate 38 and another bracket 46.1 secured to an air cylinder 46. The proximity switch 141 is interposed between the upper clamp bushing 34 and plate 38. While in theory the encoder could be used to sense contact, in practice it has been found desirable to use the separate proximity switch 141.

Step 3

A signal will now be sent by the controller 100 to the servo motor 30 to discontinue the operation of the screw 28, and the frame 26 will stop after a limited amount of overtravel. The encoder 140 will measure the amount of overtravel of the frame 26 with respect to the work plane 124, the signal from the encoder being received by controller 100. The encoder is disposed between the pressure foot plate 38 and cylinder 46 as the upper clamp bushing 34 and pressure foot plate 38 will be restrained against downward movement during the overtravel of the frame 26 as the movement of the bushing is blocked by the workpieces 10, 12, whereas the cylinder 46, which is mounted on frame 26 will continue its downward movement during the overtravel of the frame. Thus, the encoder is capable of measuring the distance of overtravel. Air within the air cylinders 46 above the upper clamp 34 will be vented through a check valve 142, shuttle valve 106, and pressure regulating valve 128 during frame overtravel. (The relief pressure of valve 128 is generally set so that the net downward force applied by the upper clamp bushing 34 is approximately 200 pounds greater than the upward force imposed by the lower clamp bushing 36 when it is in its raised position, the force imposed by the lower clamp bushing 36 being determined by the setting of its associated pressure regulating valve 64).

Step 4

At the completion of the overtravel of the frame 26 the controller 100 will initiate operation of the servo motor 30 in a reverse direction in accordance with a program within the controller to cause the servo motor to rotate a sufficient amount that the frame 26 is raised an amount equal to its overtravel. While this happens, the pistons 44 within cylinders 46 will again be moved downwardly to their fully extended position and the lower surface 120 of the upper clamp bushing 34 will continue to lie in the work plane 124. This step will be completed in accordance with the controller program. The completion of this step is shown in FIG. 4.

Step 5

When step 4 is completed the controller will send a signal to solenoid 144 on the two position valve 104 to cause this valve to be shifted from its blocked position to its open position. High pressure air will then commence to flow from a source of high pressure air, indicated by arrow 146, through valve 114 and then through the shuttle valve 106, causing the valve 106 to be shifted to block the flow of air from the low pressure air line 62. High pressure air is then introduced behind the pistons 44 in cylinders 46, to prevent the upward displacement of the upper clamp 34 when the lower clamp 36 is moved into contact with the workpiece 12.

Step 6

The lower or second clamp bushing 36 will now be raised by the controller sending a suitable signal to the lower ram servo valve 110 and to the "up" solenoid 147 on the lower ram proportional valve 108, causing these valves to be shifted from their blocking or centered positions, respectively to their "raise" or "up" positions. The servo valve 110 may be a Moog 760 two-stage flow control servo valve or an equivalent thereof. When these valves have both been shifted to their "up" positions oil under pressure may flow through valves 110 and 108 to the cylinder 56 beneath the lower ram piston 54, causing the lower clamp bushing 34 to move upwardly until its top surface 132 contacts the lower surface 134 of the workpiece 12. Even after the workpieces 10 and 12 become tightly sandwiched between the upper clamp bushing 34 and the lower clamp bushing 36 the piston 50 within the cylinder 48 which supports the lower clamp bushing 36 will continue its upward movement. Air trapped within the lower clamp cylinder 48 is forced out through pressure control valve 64 which holds the air within cylinder 48 at a constant pressure. This maintains a constant force between the upper and lower clamp bushings 34, 36, respectively. The oil or hydraulic fluid which is introduced into the cylinder 56 behind piston 54 is received from a suitable hydraulic pump 148, which pump in turn draws hydraulic fluid from reservoir 150 through filter 152. Hydraulic fluid displaced from the upper end of cylinder 56 above piston 54 will be returned to reservoir.

Step 7

Step 6 will be completed when a clamp signal device 154 (carried by the lower clamp piston 50) is actuated, which device will send a signal to the controller 100 which will in turn command proportional valve 108 to switch to its blocking position thereby locking piston 54 within the lower ram cylinder 56. The clamp signal device 154 is a proximity switch sensor which senses differential movement between the lower clamp cylinder 48 and the lower clamp piston 50. The sensor is adjustable during initial machine set up to account for physical differences between machines. The completion of the clamping step is illustrated in FIG. 5.

Step 8

Aligned apertures are now drilled through the workpieces 10, 12, and at the same time a countersink is produced in the upper workpiece to a preset depth. Thus, the controller will send a suitable signal to drill motor 80 to cause the motor to rotate and will also send a suitable signal to solenoid 155 which will shift valve 118 to its down position, causing piston rod 76 to be moved down at a suitable rate. The drill bit 156 (FIG. 6) for the above is carried by a chuck (not shown) on the drill arbor 82. While the drilling operation takes place a slug rivet R, which is to be inserted into the apertures being drilled, is inserted into a cavity below the first riveting ram 96 in accordance with the method and apparatus disclosed in co-pending U.S. patent application serial No. 947,850, the subject matter of which is incorporated herein by reference thereto. (This apparatus is indicated schematically by phantom lines in FIG. 2.) The drilling step is illustrated in FIG. 6. At the completion of the drilling step, the position of valve 118 will be changed so that the drill bit 156 will be retracted fully until it is above the top of the pressure foot plate 38.

Step 9

The controller will now cause the sub-frame 66 to be shifted to its second position to place the buck ram 96 in an operative position where it is aligned with the apertures in the workpieces 10, 12.

Step 10

An upper die cavity is now set by extending the bucking ram 96 all the way down to its lowermost position. This is done by the controller switching valve 112 from its "up" to its "down" position by sending a signal to solenoid 160. The anvil 96 and die button 98 (FIG. 7) carried by the lower end of the buck ram 96 are of such a length that when the buck ram piston 94 is in its lowermost position within cylinder 90 the upper die cavity will be properly established. The completion of this step is illustrated in FIG. 7.

Step 11

The completion of the above step will be sensed by limit switch 162 (which may be mounted on the frame or sub-frame at any convenient location), the limit switch contacting the top surface 164 of piston rod 92, or any suitable structure carried by the upper end of the rod. The controller will now send a signal to solenoid 166 on valve 114 to cause the valve to be shifted from its blocking position to its open position. Oil under pressure will now be introduced into intensifier 116 and high pressure oil will be discharged through line 168, which line is connected to line 170 through which low pressure oil normally flows into valve 112. Check valve 172 will prevent back flow of the high pressure oil into the low pressure oil system. The buck ram 96 is now essentially locked against upset force.

Step 12

The controller will now cause the lower anvil or the lower riveting ram 86 to be raised to its snug up position by sending a signal to variable solenoid 147 on valve 108 to shift the valve spool to a "raise" or "up" position. Oil will now flow through the servo valve 110 and the proportional valve 108 into the lower end of cylinder 56 forcing the lower ram piston 54 and piston rod 52 upwardly, which piston rod in turn carries the lower clamp piston 48 and the second riveting ram 86.

Step 13

Step 12 will be completed when a signal is received by the controller from load cell 88 which senses initial contact. At this time the controller will send a signal to variable solenoid 176 to cause the proportional valve 108 to be switched back to its blocking position. Also, the high pressure air valve will be caused to be switched back to its blocking position causing shuttle valve 106 to switch to its other position putting the pressure foot cylinders 46 under the control of the lower pressure air as received from the pressure foot valve 102. The completion of this step is shown in FIG. 8 and also in FIG. 2.

Step 14

The controller will now initiate upset by shifting the proportional valve 108 back to its "raise" position which will cause oil to be introduced into the cylinder 56 behind piston 54 which will in turn raise the lower anvil. The proportional valve 108 can, by imposition of a variable current through solenoid 147, act as a flow control. Current strength is set by adjustment of potentiometers in the controller 100 and the potentiometers are selected by the program within the controller. Thus, the "upset speed" potentiometer is selected and a corresponding current is sent to the solenoid 147. A controlled flow of oil is thereby sent to the lower ram cylinder which causes the lower riveting ram 86 to raise.

Step 15

After the upsetting is initiated in the previous step, upsetting will be monitored both by the encoder 140 and load cell 88. As the first riveting ram 96 can not move due to the high pressure oil introduced into the cylinder 90 behind piston 94 the upper clamp bushing or first clamp 34 will start to shift with respect to the air cylinders 46, excess air being dumped through relief valve 128. The encoder (which may be a DT-25 Industrial Encoder manufactured by DATATECHnology) measures the displacement of the pressure foot plate 38 with respect to the cylinders 46. As the controller receives a signal from the encoder it will cause the servo motor 30 to shift the frame downwardly an amount equal to the displacement of the pressure foot plate 38 so that there is only a slight upward movement (less than 0.005 inches) of the workpiece 10 during upsetting. While this is taking place the load cell is measuring the force being applied by the riveting rams 96 and 86. The signal transmitted by the load cell will be processed by the controller to progressively throttle down the servo valve 110 by slowly shifting it towards its central position until a setting of the load cell, which indicates full upset, is satisfied. Thus, the upsetting step is completed when the controller, in response to a signal received from the load cell, causes the servo valve 110 to be fully shifted to its blocking position. At this time, as there is no further displacement of the pressure foot plate 38, the movement of the frame 26 will be arrested. Thus, in summary, upsetting is accomplished by substantially equal movements of the second or lower riveting ram upwardly and downward movement of the frame 26 until upsetting is complete.

Step 16

The various parts will now be held with the upset slug rivet under compression until a timer within the controller 100 times out.

Step 17

A decompression step is now initiated by causing the servo valve 110 to switch just slightly to a "down" position to permit a slow drain to reservoir thereby permitting oil within the lower ram cylinder 56 to drain back through the pressure port in the proportional valve 108.

Step 18

The foregoing step will be completed when the load cell 88 senses a zero pressure, the controller then switching the servo valve 110 back to its blocking position and the proportional valve 108 to its centered position. This step is shown in FIG. 9. At the same time the two position valve 114 upstream of the intensifier 116 is shifted back to its blocking position putting the bucking ram cylinder 90 under the control of low pressure oil only.

Step 19

The controller 100 will now cause the servo motor 30 to shift the frame 26 upwardly to that position which it occupied prior to the upsetting of the slug rivet in accordance with the instructions which it received from the encoder 140 during the upsetting step. Simultaneously the proportional valve 108 will be shifted to a controlled "down" position and the servo valve will be shifted to a full open "up" position causing the lower ram to be moved downwardly at a rate approximately two times greater than the frame up rate.

Step 20

The frame up movement will be completed when the frame 26 has achieved that position which it occupied immediately prior to the upset step.

Step 21

The lower ram will complete its downward movement when the lower end 52.2 of piston rod 52 contacts a limit switch 178 mounted upon any convenient location on the frame 26, the limit switch sending a signal to the controller 100 which will then cause the servo valve 110 to be shifted to its blocking position and the proportional valve 108 to be shifted to its centered position.

Step 22

At the completion of step 21, or simultaneously with the operation of step 21, the controller will send a signal to solenoid 180 to cause the buck ram valve 112 to be shifted to its "raise" position to cause the bucking ram to be raised above the pressure foot plate 38.

Step 23

Step 22 will be completed when the bucking ram contacts limit switch 182 (which may be located at any suitable location on the frame 26). The completion of this step is shown in FIG. 10.

Step 24

The controller 100, after receiving a signal from the limit switch 182, will cause the frame to raise to its initial position under the control of servo motor 30. At the same time the controller will also initiate operation of the stepping motor and shaft 68 to cause the subframe 66 to be shifted back to its initial position where the drill bit is disposed in a concentric manner with respect to the upper clamp bushing 34. The completion of this step is shown in FIG. 11.

Step 25

The controller will now cause the pressure foot valve 102 to be switched to its "up" position by sending a signal to solenoid 184. When the valve 102 is shifted to its "up" position low pressure air will flow through restrictor 186 and will be introduced below the pistons 44 as shown in FIG. 2. When the pistons 44 have achieved their full up position within cylinders 46 additional clearance will be provided between the lower surface 120 of the first clamp 36 and the workpiece 10, and the frame 26 can now be moved to another riveting position. When the frame is properly positioned with respect to its next riveting position the sequence of steps set forth above may now be repeated.

It should be observed from the above that the tooling carried by the frame, namely either the drill or the upper riveting ram, has been properly positioned with respect to the workpieces, which are not supported by the frame which carries the tooling, without undue movement of the workpiece. Thus, by providing a first clamp which can telescope with respect to the frame which carries the tooling, it is possible to move the frame towards the workpieces until the first clamp contacts the workpieces, whereby additional inertial movement of the frame towards the workpieces will not affect the position of the workpiece as the bushing which contacts the workpieces will be permitted to collapse with respect to the frame during the overtravel of the frame towards the workpieces. By measuring this amount of overtravel it is then possible to properly position the frame with respect to the workpieces so that the first clamp can be positioned in a fully extended position where it is just in contact with the upper surface of the workpieces. It is then possible to move the second clamp into engagement with the outer side of another workpiece to properly clamp the workpieces without deflecting the outer surface of the first workpiece which establishes the desired work plane.

Additionally, by effectively locking or holding the first riveting ram with respect to the frame which carries it and again by permitting the first clamp to collapse with respect to the frame it is possible to upset both ends of a slug rivet without deflecting the outer surface 122 of the first workpiece 10. Thus, as the lower riveting ram 86 is moved upwardly to upset the lower head of rivet 98, even the slightest amount of deflection of the upper surface of the upper workpiece may be measured by the encoder 140 which will initiate corresponding downward movement of the frame and upper or first riveting ram 96 thereby effectively preventing any movement or winking of the workpieces 10, 12.

While a preferred structure in which the principles of the present invention have been incorporated is shown and described above, it is to be understood that widely differing means may be employed in the broader aspects of this invention. Accordingly, this invention is intended to embrace all such alternatives, modifications, and variations which fall within the spirit and scope of the appended claims.

What is claimed is:

1. A method of positioning tooling with respect to two or more side by side workpieces which are to be clamped together, an outer side of one of the workpieces establishing a substantially fixed work plane; said method comprising the following steps:

providing a frame movable in a direction perpendicular to said work plane, the tooling being mounted on the frame;

providing first and second opposed spaced apart clamps movably mounted on the frame;

positioning the frame relative to the workpieces so that the area of the workpieces to be engaged by the tooling is disposed between the first and second clamps, the first clamp being disposed in an extended position;

moving the frame to cause the first clamp to move towards said outer side;

sensing when the first clamp comes into contact with said outer side and initiating stopping movement of the frame;

permitting the first clamp to stop in contact with the outer side while the frame continues to move until it is completely stopped;

measuring the distance the frame overtravels after the first clamp initially contacted the outer side;

backing the frame away a distance equal to the amount of overtravel while maintaining the first clamp in contact with the outer side, the first clamp being back in its extended position when the frame has been fully backed away a distance equal to the amount of overtravel;

locking the first clamp in its extended position; and extending the second clamp into contact with the other side of the workpieces so that the workpieces are firmly engaged between the clamps.

2. The method as set forth in claim 1 wherein the tooling includes a drill, and further characterized by the additional step of drilling aligned apertures through the two or more clamped workpieces.

3. A method of riveting two or more side by side workpieces together, an outer side of one workpiece establishing a substantially fixed work plane, the workpieces further being provided with transversely extending aligned apertures in which a slug rivet has been received; said method comprising the following steps:

providing a frame movable in a direction perpendicular to said work plane;

providing first and second opposed riveting rams movably mounted on the frame and aligned with the slug rivet, the first and second riveting rams being disposed on opposite sides of the workpieces;

moving the first riveting ram with respect to the work plane to establish a first desired die cavity;

moving the second riveting ram towards the first riveting ram until both ends of the slug rivet are just in contact with the ends of both riveting rams;

upsetting heads on both ends of the slug rivet by moving the second riveting ram towards the workpieces, and, essentially at the same time, moving the frame towards the workpieces at a rate equal to the movement of the second riveting ram, the first riveting ram being held from movement with respect to the frame, whereby the outer side of the one workpieces continues to be disposed in the work plane during the upsetting of the slug rivet; and moving the first riveting ram away from the workpieces while simultaneously moving the second riveting ram away from the workpieces at a rate substantially equal to the movement of the first ram to cause the rams to become disengaged from the upset slug rivet while said outer side of the one workpiece continues to be disposed in the work plane.

4. The method of riveting as set forth in claim 3 wherein the riveting rams are held in contact with the upset heads on both ends of the slug rivet at the completion of the upsetting step during a dwell time and subsequently during a decompression period of time.

5. A method of positioning tooling and riveting two or more side by side workpieces together, an outer side of one of the workpieces establishing a substantially fixed work plane; said method comprising the following steps:

providing a frame movable in direction perpendicular to said work plane, the tooling being mounted on the frame, said tooling including first and second opposed aligned riveting rams which are movably mounted on the frame;

providing first and second opposed spaced apart clamps movably mounted on the frame;

positioning the frame relative to the workpieces so that the area of the workpieces to be engaged by the tooling is disposed between the first and second clamps, the first clamp being disposed in an extended position;

moving the frame to cause the first clamp to move towards said outer side;

sensing when the first clamp comes into contact with said outer side and initiating stopping movement of the frame;

permitting the first clamp to collapse with respect to the frame as the frame overtravels;

measuring the distance the frame overtravels with respect to the outer side;

backing the frame away a distance equal to the amount of overtravel while extending the first clamp back to its extended position;

locking the first clamp in its extended position;

extending the second clamp into contact with the other side of the workpieces so that the workpieces are firmly engaged between the clamps;

positioning a slug rivet within apertures within the workpieces, which apertures are aligned with the first and second opposed riveting rams;

moving the first riveting ram with respect to the work plane to establish a first desired die cavity;

moving the second riveting ram towards the first riveting ram until both ends of the slug rivet are just in contact with the ends of both riveting rams;

upsetting heads on both ends of the slug rivet by moving the second riveting ram towards the workpieces, and, essentially at the same time, moving the frame towards the workpieces at a rate equal to the movement of the second riveting ram, the first riveting ram being held from movement with respect to the frame, whereby the outer side of the one workpiece continues to be disposed in the work plane during the upsetting of the rivet; and moving the first riveting ram away from the workpieces while simultaneously moving the second riveting ram away from the workpieces at a rate substantially equal to the movement of the first ram to cause the rams to become disengaged from the upset slug rivet while said outer side of the one workpiece continues to be disposed in the work plane.

6. The method as set forth in claim 5 wherein the tooling further includes a drill, and wherein aligned apertures are drilled in the workpieces after the second clamp has been extended into contact with the other side of the workpieces and prior to that step wherein the slug rivet is inserted into the aligned apertures.

7. The method as set forth in claim 5 further characterized by the additional steps of moving the second clamp away from the other side of the workpieces; and then moving the frame and first clamp away from the outer side of said one workpiece.

8. A method of positioning tooling and riveting two or more side by side workpieces not held by a frame which carries the tooling, the outer side of one of the workpieces establishing a substantially a fixed work plane; said method comprising the following steps:

providing a frame movable in a direction perpendicular to said work plane;

providing a sub-frame mounted on the frame and movable between first and second positions, said sub-frame carrying tooling in the form of a drill and a first riveting ram movable with respect to the sub-frame, the sub-frame initially being in its first position;

providing first and second opposed spaced apart clamps movably mounted on the frame and a second riveting ram also movably mounted on the frame;

positioning the frame relative to the workpieces so that the area of the workpieces to be engaged by the tooling is disposed between the first and second clamps;

moving the first clamp to an extended position;

moving the frame to cause the extended first clamp to move towards said outer side;

sensing when the extended first clamp comes into contact with said outer side and initiating stopping movement of the frame;

permitting the extended first clamp to collapse with respect to the frame as the frame overtravels;

measuring the distance the frame overtravels with respect to the outer side;

backing the frame away a distance equal to the amount of overtravel while maintaining the first clamp in contact with the outer side until it resumes its extended position;

locking the first clamp in its extended position;

extending the second clamp into contact with the other side of the workpieces so that the workpieces are firmly engaged between the clamps;

drilling aligned apertures through the workpieces;

moving the sub-frame to its second position to place the first riveting ram in alignment with the aligned apertures;

inserting a slug rivet into said aligned apertures and moving the first riveting ram with respect to the work plane to establish a first desired die cavity;

moving the second riveting ram towards the first riveting ram until both ends of the slug rivet are just in contact with the ends of both riveting rams;

upsetting heads on both ends of the slug rivet by moving the second riveting ram towards the workpiece, and, essentially at the same time, moving the frame towards the workpieces at a rate equal to the movement of the second riveting ram, the first riveting ram being held from movement with respect to the frame, and the outer side of the one workpiece continuing to be disposed in the work plane during the upsetting of the riveting;

moving the first riveting ram away from the workpiece while simultaneously moving the second riveting ram away from the workpiece at a rate substantially equal to the movement of the first riveting ram to cause the rams to become disengaged from the upset slug rivet while the outer side of the one workpiece continues to be disposed in the work plane;

moving the lower clamp away from the other side of the workpieces; and moving the frame and the first clamp away from the outer side of said one workpiece.

9. The method as set forth in claim 8 further characterized by the steps of moving the first clamp to its fully retracted position and moving the sub-frame to its first position.

10. The method as set forth in claim 9 further characterized by the step of repositioning the frame relative to the workpieces so that the next area of the workpieces to be engaged by the tooling is disposed between the first and second clamps.

11. Apparatus for positioning tooling with respect to two or more side by side workpieces which are to be clamped together, an outer side of one of the workpieces establishing a substantially fixed work plane; said apparatus comprising:

a frame movable relative to said work plane, the tooling being mounted on the frame;

first and second opposed spaced apart clamps mounted on the frame for movement towards and away from each other between extended and retracted positions, respectively;

frame positioning means for properly positioning the frame in a plane generally parallel to the work plane so that the area of the workpieces to be engaged by the tooling is disposed between the first and second clamps;

first clamp moving means for initially moving the first clamp towards its extended position after the frame positioning means has properly positioned the frame;

frame moving means for moving the frame towards and away from said outer side when the first clamp is in its extended position;

first clamp sensing means for sensing when the first clamp comes into contact with said outer side said sensing means including means for measuring the distance the frame overtravels after the first clamp initially contacts the outer side;

controller means interconnected with the frame moving means and the first clamp sensing means and for initiating stopping movement of the frame when the first clamp sensing means senses initial contact between the first clamp and the outer side, said controller means being capable of initiating reverse operation of the frame moving means after the frame comes to a stop to back the frame away a distance equal to the amount of overtravel;

first clamp locking means for locking the first clamp in an extended position after the controller means has caused the frame to back away a distance equal to the amount of overtravel; and second clamp moving means for extending the second clamp into contact with the other side of the workpieces so that the workpieces are firmly engaged between the clamps after the first clamp has been locked in an extended position.

12. Apparatus for riveting two or more side by side workpieces together, an outer side of one of the workpieces establishing a substantially fixed work plane, the workpieces further being provided with transversely extending aligned apertures in which a slug rivet has been received; said apparatus comprising:

frame means movable in a direction perpendicular to said work plane;

first and second opposed riveting ram means movably mounted on the frame and aligned with the slug rivet, the first and second riveting rams being disposed on opposite sides of the workpieces;

first riveting ram moving means for moving the first riveting ram with respect to the work plane and the frame to establish a first desired die cavity, said first riveting ram means being in an extended position when the first desired die cavity is established;

holding means for holding the first riveting ram from movement with respect to the frame once the first desired die cavity has been established;

second riveting ram moving means for moving the second riveting ram towards the first riveting ram until both ends of the slug rivet are just in contact with the ends of both riveting rams;

rivet contact sensing means for sensing when both ends of the slug rivet are just in contact with the ends of both riveting rams; and frame moving means for moving the frame towards the workpieces during an upsetting operation wherein the frame is moved towards the workpieces at a rate equal to the opposite movement of the second riveting ram whereby heads on both ends of the slug rivet are upset.

13. Apparatus for positioning tooling and riveting two or more side by side workpieces together, an outer side of one of the workpieces establishing a substantially fixed work plane; said apparatus comprising:

frame means movable relative to said work plane;

first and second opposed aligned riveting rams movably mounted on the frame;

first and second opposed spaced apart clamps movably mounted on the frame for movement towards and away from each other between extended and retracted positions, respectively;

frame positioning means for properly positioning the frame in a plane generally parallel to the workpieces so that the area of the workpieces to be engaged is disposed between the first and second clamps;

first clamp moving means for initially moving the first clamp from a retracted position to an extended position;

frame moving means for moving the frame towards and away from the outer side when the first clamp is in its extended position;

first clamp sensing means for sensing when the first clamp comes into contact with said outer side, said sensing means including means for measuring the distance the frame overtravels after the first clamp initially contacts the outer side;

first clamp locking means for locking the first clamp in its extended position;

second clamp moving means for extending the second clamp into contact with the other sides of the workpieces so that the workpieces are firmly engaged between the clamps when the first clamp is in an extended position;

slug positioning means for positioning a slug rivet within apertures within the workpieces, which apertures are aligned with the first and second opposed riveting rams;

first riveting ram moving means for moving the first riveting ram with respect to the work plane and the frame to establish a first desired die cavity;

first riveting ram holding means for holding the first riveting ram in an extended position when the first desired die cavity is established;

second riveting ram moving means for moving the second riveting ram towards the first riveting ram until both ends of the slug rivet are just in contact with both riveting rams;

rivet contact sensing means for sensing when both ends of the rivet have been contacted;

second riveting ram moving means and frame moving means for moving said first and second riveting rams oppositely against the slug rivet ends at an equal rate of movement to upset heads thereon; and controller means for controlling the operation of the various structures set forth above so that the workpieces may be clamped between the first and second clamp means and so that heads on both ends of the slug rivet may be upset at the same time without displacing the outer side of said one workpiece from the substantially fixed work plane, said controller means also permitting movement of the parts away from the workpieces after completion of the upsetting without movement of the workpieces.

14. The apparatus as set forth in claim 11, 12 or 13 wherein the frame means is mounted on a threaded shaft, which shaft defines a an axis, and wherein a stepping motor is provided to cause the shaft to be rotated to either raise or lower the frame.

15. The apparatus as set forth in either claim 11 or claim 13 wherein the first and second opposed spaced apart clamps are interconnected with the frame by air cylinder assemblies.

16. The apparatus as set forth in either claim 11 or claim 13 wherein the first clamp is interconnected with the piston rod of an air cylinder, the first clamp being in an extended position when the piston rod is fully extended within the air cylinder and being in a retracted position when the piston rod is fully retracted within the air cylinder.

17. The apparatus as set forth in claim 16 wherein the first clamp moving means includes a source of low pressure air and a first clamp moving valve shiftable between first and second positions to cause the piston rod to be either extended or retracted.

18. The apparatus as set forth in claim 17 wherein the first clamp locking means includes a source of high pressure air, a two position valve movable between blocked and open positions, which two position valve when in its open position causes high pressure air to be directed to the air cylinder to maintain the piston rod in its extended position.

19. The apparatus as set forth in claim 11 or 13 wherein the first clamp sensing means includes a proximity switch associated with the first clamp which is capable of sensing when the first clamp comes into contact with said outer side.

20. The apparatus as set forth in claim 11 or 13 wherein the first clamp sensing means includes an encoder for measuring the distance the frame overtravels after the first clamp initially contacts the outer side.

21. The apparatus as set forth in claim 20 wherein the encoder is mounted on the first clamp and a relatively stationary member.

22. The apparatus as set forth in either claim 11 or 13 wherein the second clamp is mounted on an air cylinder, said air cylinder in turn being supported upon a piston carried by a piston rod, an intermediate portion of the piston rod being provided with a further piston disposed within a hydraulic cylinder, and wherein the second clamp is normally biased to an extended position by low pressure air which passes through a pressure regulator valve, the second clamp being shifted to a clamping position by movement of the piston rod towards the workpieces until the second clamp is in engagement with the workpieces, the pressure imposed by the second clamp being established by the pressure regulating valve.

23. The apparatus as set forth in either claim 12 or 13 wherein the first and second opposed riveting rams are carried by first and second piston rods, respectively, the first and second piston rods extending outwardly from first and second hydraulic cylinders, respectively.

24. The apparatus as set forth in claim 23 wherein the first riveting ram moving means includes a source of low pressure hydraulic fluid and a two position directional flow valve interposed between the source of hydraulic fluid and the first cylinder and capable of being shifted between "raise" and "lower" positions to move the riveting ram between retracted and extended positions, respectively.

25. The apparatus as set forth in claim 24 wherein the holding means for holding the first riveting ram from movement includes a source of high pressure oil interconnected with the two position valve, the high pressure oil being capable of holding the first riveting ram in its extended position when the two position valve is in its "lower" position.

26. The apparatus as set forth in claim 12 or 13 wherein the second riveting ram moving means includes a source of low pressure hydraulic fliud, a lower ram servo pressure valve and a lower ram proportional control valve downstream of the lower ram servo pressure control valve.

27. The apparatus as set forth in either claim 12 or 13 wherein the rivet contact sensing means is a load cell interposed between the lower riveting ram and the air cylinder piston which supports the second clamp.

28. The apparatus as set forth in claim 13 further characterized by the provision of a sub-frame shiftable in a plane generally parallel to the work plane, the sub-frame being carried by said frame means, said sub-frame being shiftable between first and second positions, said tooling including drill means carried by the sub-frame and capable of being positioned in coaxial alignment with the first and second clamps when the sub-frame is in a first position, and the tooling also including the first and second riveting rams, which riveting rams are capable of being placed in coaxial alignment with the first and second clamps when the sub-frame is in its second position.

* * * * *

UNITED STATES PATENT AND TRADEMARK OFFICE

CERTIFICATE OF CORRECTION

PATENT NO. : 4,864,713

DATED : September 12, 1989

INVENTOR(S) : Bradley M. Roberts et al

It is certified that error appears in the above-identified patent and that said Letters Patent is hereby corrected as shown below:

Claim 14, line 3, delete "a" before --an--.

Signed and Sealed this

Seventh Day of August, 1990

*Attest:*

HARRY F. MANBECK, JR.

*Attesting Officer*

*Commissioner of Patents and Trademarks*